US005447821A

United States Patent [19]

Okada et al.

[11] Patent Number: 5,447,821

[45] Date of Patent: Sep. 5, 1995

[54] REDUCER AND REDUCTION METHOD FOR SILVER IMAGES

[75] Inventors: Hisashi Okada; Morio Yagihara; Katsumi Hayashi, all of Minami-Ashigara, Japan

[73] Assignee: Fuji Photo Film Co., Ltd., Kanagawa, Japan

[21] Appl. No.: 368,731

[22] Filed: Jan. 4, 1995

Related U.S. Application Data

[63] Continuation of Ser. No. 5,328, Jan. 15, 1993.

[30] Foreign Application Priority Data

Jan. 16, 1992 [JP] Japan ..... 4-005404

[51] Int. Cl.[6] ..... G03C 5/42

[52] U.S. Cl. ..... 430/265; 430/331; 430/430; 430/461

[58] Field of Search ..... 430/265, 331, 430, 461

[56] References Cited

U.S. PATENT DOCUMENTS

| | | | |
|---|---|---|---|
| 4,837,122 | 6/1989 | Kondo et al. | 430/331 |
| 5,009,985 | 4/1991 | Kunitz et al. | 430/461 |
| 5,139,920 | 8/1992 | Hayashi et al. | 439/264 |
| 5,188,927 | 2/1993 | Okada et al. | 430/430 |
| 5,250,402 | 10/1993 | Okada et al. | 430/430 |
| 5,256,531 | 10/1993 | Okada et al. | 430/430 |

FOREIGN PATENT DOCUMENTS

| | | |
|---|---|---|
| 52-68419 | 6/1977 | Japan . |
| 1282551 | 11/1989 | Japan . |

*Primary Examiner*—Hoa Van Le
*Attorney, Agent, or Firm*—Sughrue, Mion, Zinn, Macpeak & Seas

[57] ABSTRACT

A reducer containing a ferric chelate compound of an amino compound and further containing an reduction accelerator and/or a complex-forming agent and a dye.

wherein $A_{41}$, $A_{42}$ and $A_{43}$ each individually represents a carboxyl group, a phosphono group, a sulfo group or a hydroxyl group; $L_{41}$ and $L_{42}$ each individually represents a divalent coupling group containing an aliphatic group, an aromatic group, a heterocyclic group or combinations thereof; $R_{41}$ represents a substituent; and a represents 0, 1, 2, 3 or 4. The reducer is superior in the rate of reduction, reducibility and reduction working properties and so stable that no precipitate will separate out with time. Also disclosed is a silver image reducing method wherein a silver image formed by exposing and developing a silver halide photosensitive material is reduced in the presence of the above-described reducer. The reducer and the reducing method are suitable for application to high-contrast photosensitive materials.

7 Claims, No Drawings

REDUCER AND REDUCTION METHOD FOR SILVER IMAGES

This is a Continuation of application Ser. No. 08/005,328 filed Jan. 15, 1993.

BACKGROUND OF THE INVENTION

The present invention relates to a reduction method for correcting silver images comprising dots or/and lines, which are obtained by developing silver halide photosensitive materials, particularly a photosensitive material for plate-making, after exposure. More particularly, the present invention relates to a reducer which has superior reducibility and excellent shelf stability and which causes no yellow stain on a photosensitive material after it has been treated therewith.

There are many literatures and patents concerning reduction of silver images, particularly dot or line silver images formed on a photosensitive material for plate-making, and various reducers have heretofore been used. In the old days, the Farmer's reducer, containing potassium ferricyanide as the principal component, was a common reducer. Recently, however, a cerium sulfate reducer and a ferric ethylenediaminetetraacetic acid chelate reducer have been used from the viewpoint of environmental pollution.

As a photosensitive material for plate-making, so-called lithographic film has mainly been employed. However, new high-contrast photosensitive materials, which contain a hydrazine compound or a tetrazolium compound, have recently been employed. Therefore, the required reducer characteristics have also changed.

The Farmer's reducer is neutral and has excellent reduction characteristics, but it involves a pollution problem and is inferior in keeping property. The cerium sulfate reducer is excellent in keeping property and has relatively good reducibility, but it is strongly acidic and hence inferior in handling properties, and it suffers from the disadvantage that a yellow stain is likely to be left in the non-image area. The ferric ethylenediaminetetraacetic acid chelate reducer is neutral and less costly, but it is inferior in reducibility. With a new high-contrast photosensitive material of high silver iodide content, a yellowish brown residue occurs around the silver image, and the effective reduction range decreases. In addition, a yellow stain is left in the image area after the reduction process.

The expression "excellent reducibility" as used herein means that the ratio of the decrease in area of the silver image to the lowering in density of the silver image is high, that is, the reduction range is wide.

Japanese Patent Application Laid-Open (KOKAI) No. 1-282551 (1989) discloses a reducer containing ferric 1,3-diaminopropanetetraacetic acid chelate, as a reducer that solves the above-described problems. However, this reducer has been revealed to be disadvantageous in that with passage of time, a precipitate separates out, and the reducibility lowers.

Further, since the conventional ferric aminopolycarboxylic acid chelate is generally weak in oxidizing power, the rate of reduction (oxidation) thereof is low in comparison to cerium sulfate, potassium ferricyanide, etc. Therefore, it is difficult to form a practical reducer by using the conventional ferric aminopolycarboxylic acid chelate. Even if reduction is carried out for a long time with a compound containing such material, the dot density lowers to a substantial degree, and a yellow stain occurs in the image area after the reduction process, particularly when it is used in combination with the above-described new high-contrast photosensitive material. In addition, it is likely that a yellowish residue will be left around each dot.

Further, Japanese Patent Application Laid-Open (KOKAI) No. 52-68419 (1977) discloses a reducer that uses a heterocyclic mercapto compound, particularly a combination of such a compound and ferric ethylenediaminetetraacetic acid chelate. However, this combination cannot solve the above-described problems, either.

On the other hand, the finished condition of the plate-making material often needs correction at the customer's request. It is a common practice to use a reducer for correction of a local area. The reducing operation is usually conducted on a light table where water is flowing (i.e., a washing light table). Since the reducer is light yellow, even if the reducer flows out to an area other than a predetermined area, the operator is likely to be unaware of it and let a necessary portion to disappear undesirably. Hitherto, such a problem has often occurred.

Further, care must been taken when a plate-making material subjected to a reduction process is to be printed on a press plate because the image density in the reduced area has been lowered due to oxidation of silver. A problem often arises from this, particularly when the reducing process and the press plate making process are carried out in different places.

However, the conventional reducer containing ferric aminopolycarboxylic acid chelate as an oxidizing agent causes a yellowish brown residue to be left around each dot, so that the reduced area cannot be distinguished from the other area by a visual observation, although it can be done by an observation with a microscope.

It is a first object of the present invention to provide an improved reducer, which is free from the above-described problems.

It is a second object of the present invention to provide a reducer and a reduction method, which are particularly suitable for the above-described new high-contrast photosensitive materials.

It is a third object of the present invention to provide a reducer of excellent working properties, which enables perception of the outflow of the reducer and the reduced area in particular.

SUMMARY OF THE INVENTION

As a result of examination of a large number of reducers, we have found that the above-described first and second objects can be attained by a reducer containing a ferric chelate compound of at least one amino compound selected from among those represented by the following formulae (1), (2), (3), (4), (5), (7), (8) and (9).

Formula (1): 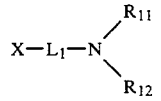

where in X represents $-C(=X_{11})-N(Ra)-Rb$, $-N(Rc)-C(=X_{12})-Rd$, $-SO_2NRe(Rf)$, $-N(Rg)SO_2Rh$, or $-SRi$ ($X_{11}$ and $X_{12}$ each represent oxygen atom or sulfur atom; Ra, Rc, Re and Rg each represent hydrogen atom, a hydroxyl group, an aliphatic group, an aromatic group, or a heterocyclic group; Rb, Rf and Ri each represent hydrogen atom, an aliphatic group, an aromatic group, or a heterocyclic group; and Rd and Rh each represent an aliphatic group, an aromatic group, a heterocyclic group, —N(Rj)—Rk (Rj and Rk are the same as Rb), or —ORm (Rm represents an aliphatic group, an aromatic group, or a heterocyclic group)); $L_1$ represents a divalent coupling group containing an aliphatic group, an aromatic group, a heterocyclic group, and/or a group comprising a combination of these groups; and $R_{11}$ and $R_{12}$ each represent hydrogen atom, an aliphatic group, an aromatic group, or a heterocyclic group.

Formula (2):

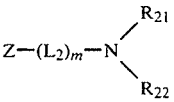

wherein $R_{21}$ and $R_{22}$ are the same as $R_{11}$ in formula (1); Z represents a heterocyclic group; $L_2$ represents a divalent coupling group; and m represents 0 or 1.

Formula (3):

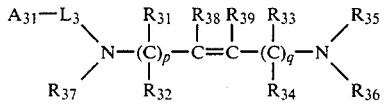

wherein $L_3$ represents a divalent coupling group containing an aliphatic group, an aromatic group, a heterocyclic group, and/or a group comprising a combination of these groups; $A_{31}$ represents a carboxyl group, a phosphono group, a sulfo group, or a hydroxyl group; $R_{31}$, $R_{32}$, $R_{33}$, $R_{34}$, $R_{35}$, $R_{36}$ and $R_{37}$ each represent hydrogen atom, an aliphatic group, an aromatic group, or a heterocyclic group; $R_{38}$ and $R_{39}$ each represent hydrogen atom, an aliphatic group, an aromatic group, a heterocyclic group, a halogen atom, cyano group, nitro group, an acyl group, a sulfamoyl group, a carbamoyl group, an alkoxycarbonyl group, an aryloxycarbonyl group, a sulfonyl group, or a sulfinyl group; $R_{38}$ and $R_{39}$ may link together to form a ring; and p and q each represent 0 or 1.

Formula (4):

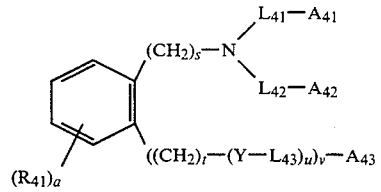

wherein $A_{41}$, $A_{42}$ and $A_{43}$ are the same as $A_{31}$ in formula (3); $L_{41}$, $L_{42}$ and $L_{43}$ are the same as $L_1$ in formula (1); Y represents oxygen or sulfur atom; s, t, u and v each represent 0 or 1; $R_{41}$ represents a substituent; and a represents 0, 1, 2, 3 or 4.

Formula (5):

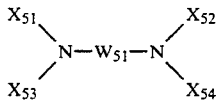

wherein $X_{51}$, $X_{52}$, $X_{53}$ and $X_{54}$ each represent hydrogen atom, an aliphatic group, an aromatic group, a heterocyclic group, —$L_{51}$—$A_{51}$ ($L_{51}$ is the same as $L_1$ in formula (1); and $A_{51}$ represents a carboxyl group, a phosphono group, a sulfo group, a hydroxyl group, a carbonamide group, a carbamoyl group, a sulfonamide group, a sulfamoyl group, a hydroxamic acid group, an alkoxy group, or an alkylthio group), or a group represented by the following formula (6); $W_{51}$ represents a divalent coupling group containing an alkylene group, and/or an arylene group; and at least one of $X_{51}$, $X_{52}$, $X_{53}$ and $X_{54}$ represents a group represented by the following formula (6):

Formula (6):

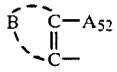

wherein B represents a group of atoms necessary for forming an aryl group or a heterocyclic group; $A_{52}$ represents hydrogen atom, a carboxyl group, a phosphono group, a sulfo group, a hydroxyl group, a carbonamide group, a carbamoyl group, a sulfonamide group, a sulfamoyl group, a hydroxamic acid group, an alkoxyl group, an alkylthio group, or an amino group.

Formula (7):

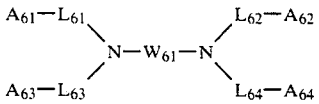

wherein $W_{61}$ represents a divalent coupling group containing a thioether group, an alkylene group, and/or an arylene group; $L_{61}$, $L_{62}$, $L_{63}$ and $L_{64}$ each represent an alkylene group; and $A_{61}$, $A_{62}$, $A_{63}$ and $A_{64}$ each represent a carboxyl group, a phosphono group, a sulfo group, or a hydroxyl group.

Formula (8):

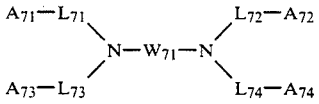

wherein $W_{71}$ represents an alkylene group having four or more carbon atoms in total; $L_{71}$, $L_{72}$, $L_{73}$ and $L_{74}$ each represent an alkylene group; and $A_{71}$, $A_{72}$, $A_{73}$ and $A_{74}$ each represent a carboxyl group, a phosphono group, a sulfo group, or a hydroxyl group.

Formula (9):

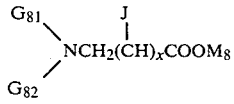

wherein J represents hydrogen atom, or a hydroxyl group; $M_8$ represents hydrogen atom, or a cation; $G_{81}$ and $G_{82}$ each represent an aliphatic, aromatic or heterocyclic group which has a hydroxyl group, a carboxyl group, a phosphono group, a sulfo group, an amino group, or an ether group as a substituent; and x represents 0 or 1.

In addition, the present invention provides a silver image reducing method wherein a silver image formed by exposing and developing a silver halide photosensitive material is reduced in the presence of a ferric chelate compound of at least one amino compound selected from among those represented by the above-described formulae (1), (2), (3), (4), (5), (7), (8) and (9).

Further, we have found that the first and second objects of the present invention can also be attained by a reducer containing a ferric chelate compound of at least one amino compound selected from among those represented by the above-described formulae (1), (2), (3), (4), (5), (7), (8) and (9), and a compound represented by the following formula (10), which is a reduction accelerator.

Formula (10):

$$A^1-(B^1)_h-A^2(Z^1)_i$$

wherein $A^1$ and $A^2$ each represent

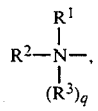

a saturated or unsaturated heterocyclic residue containing at least one nitrogen atom; $A^1$ and $A^2$ may be the same or different; $R^1$, $R^2$and $R_3$ each represent hydrogen atom, or an alkyl group; $R^1$, $R^2$ and $R^3$may be the same or different; q is 0 or 1; a nitrogen atom in the heterocyclic residue may be in the form of a quaternary ammonium salt, and the heterocyclic ring may contain oxygen atom or sulfur atom; $B^1$ represents a divalent organic group comprising alkylene, alkenylene, arylene, $—SO_2—$, —SO—, —S—, —O—,

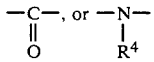

($R^4$ represents hydrogen atom, an alkyl group, or an aryl group) alone or in combination; h is 0 or 1; $Z^1$ represents an anion; and i is 0, 1 or 2.

In addition, the present invention provides a silver image reducing method which is characterized in that a silver image formed by exposing and developing a silver halide photosensitive material is reduced by using a reducer containing a ferric chelate compound of at least one amino compound selected from among those represented by the above-described formulae (1), (2), (3), (4), (5), (7), (8) and (9), and a compound represented by the above-described formula (10), which is a reduction accelerator.

Further, we have found that the third object of the present invention can be attained by a reducer containing a ferric chelate compound of at least one amino compound selected from among those represented by the above-described formulae (1), (2), (3), (4), (5), (7), (8) and (9), a complex-forming agent, and a dye.

Accordingly, the present invention further provides a silver image reducing method wherein a silver image formed by exposing and developing a silver halide photosensitive material is reduced by using a reducer containing a ferric chelate compound of at least one amino compound selected from among those represented by the above-described formulae (1), (2), (3), (4), (5), (7), (8) and (9), a complex-forming agent, and a dye.

The reducer and silver image reducing method of the present invention are superior in the rate of reduction, reducibility and reduction working properties. The reducer of the present invention is so stable that no precipitate will separate out with time. Therefore, it is suitable for application to high-contrast photosensitive materials.

DESCRIPTION OF THE PREFERRED EMBODIMENT

Compounds represented by the above-described formula (1) will be explained below more specifically.

In the formula (1), X represents $—C(=X_{11})—N(Ra)—Rb$, $—N(Rc)—C(=X_{12})—Rd$, $—SO_2NRe(Rf)$, $—N(Rg)SO_2Rh$, or —SRi ($X_{11}$ and $X_{12}$ each represent oxygen atom or sulfur atom; Ra, Rc, Re and Rg each represent hydrogen atom, a hydroxyl group, an aliphatic group, an aromatic group, or a heterocyclic group; Rb, Rf and Ri each represent hydrogen atom, an aliphatic group, an aromatic group, or a heterocyclic group; and Rd and Rh each represent an aliphatic group, an aromatic group, a heterocyclic group, —N(Rj)—Rk (Rj and Rk are the same as Rb), or —ORm (Rm represents an aliphatic group, an aromatic group, or a heterocyclic group); $L_1$ represents a divalent coupling group containing an aliphatic group, an aromatic group, a heterocyclic group, and/or a group comprising a combination of these groups; and $R_{11}$ and $R_{12}$ each represent hydrogen atom, an aliphatic group, an aromatic group, or a heterocyclic group.

Aliphatic groups represented by Ra, Rb, Rc, Rd, Re, Rf, Rg, Rh, Ri, Rj, Rk and Rm are straight chain, branched or cyclic alkyl, alkenyl or alkynyl groups, preferably a straight chain, branched or cyclic alkyl group having from 1 to 4 carbon atoms.

Aromatic groups represented by Ra, Rb, Rc, Rd, Re, Rf, Rg, Rh, Ri, Rj, Rk and Rm are monocyclic or bicyclic aryl groups. Examples of such aryl groups are phenyl and naphthyl. Phenyl is more preferable.

Heterocyclic groups represented by Ra, Rb, Rc, Rd, Re, Rf, Rg, Rh, Ri, Rj, Rk and Rm are saturated or unsaturated heterocyclic rings each comprising from 3 to 10 members including at least one selected from among N, O and S atoms. These rings may be either monocyclic rings or fused rings formed in combination with other aromatic ring or heterocyclic ring. Preferable heterocyclic rings are aromatic meterocyclic groups comprising from 5 to 6 members, for example, thiophene, furan, pyrrole, imidazole, pyrazole, pyridine, pyrazine, pyrimidine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, oxazole, etc. More preferable examples of aromatic heterocyclic groups are pyrrole, imidazole, pyrazole, pyridine, pyrazine, pyrimidine, triazole, thiadiazole, oxadiazole, quinoxaline, tetrazole, thiazole, and oxazole. Particularly preferable aromatic heterocyclic groups are pyrrole, imidazole, pyridine, triazole, thiadiazole, oxadiazole, quinoxaline, tetrazole, thiazole, and oxazole.

Ra, Rb, Rc, Rd, Re, Rf, Rg, Rh, Ri, Rj, Rk and Rm may each have a substituent. Examples of substituents are an alkyl group (e.g., methyl, ethyl, etc.), an aralkyl group (e.g., phenyl methyl), an alkenyl group (e.g., allyl), an alkynyl group, an alkoxyl group (e.g., methoxyl, ethoxyl, etc.), an aryl group (e.g., phenyl, p-methyl phenyl, etc.), an amino group (e.g., dimethylamino), an acylamino group (e.g. , acetylamino), a sulfonylamino group (e.g., methanesulfonylamino), a ureido group, a urethane group, an aryloxyl group (e.g., phenyloxy), a sulfamoyl group (e.g., methylsulfamoyl), a carbamoyl group (e.g., carbamoyl, methylcarbamoyl, etc.), an alkylthio group (e.g., methylthio), an arylthio group (e.g., phenylthio), a sulfonyl group, a sulfinyl group, a hydroxyl group, a halogen atom (e.g., chlorine, bromine, fluorine, etc.), cyano group, a sulfo group, a carboxyl group, a phosphono group, an aryloxycarbonyl group (e.g., phenyloxycarbonyl), an acyl group (e.g., acetyl, benzoyl, etc.), an alkoxycarbonyl group (e.g., methoxycarbonyl), an acyloxyl group (e.g., acetoxyl), a carbonamido group, a sulfonamido group, nitro group, a hydroxamic acid group, and a heterocyclic group. When the above-described substituents have carbon atoms, the number of carbon atoms is preferably in the range of from 1 to 10, more preferably from 1 to 4.

Further, Ra, Rb, Rc, Rd, Re, Rf, Rg, Rh, Rj and Rk may link together to form rings as follows: Ra and Rb; Rc and Rd; Re and Rf; Rg and Rh; and Rj and Rk. Examples of rings that may be formed by linking are morpholine ring, piperidine ring, pyrrolidine ring, pyrazine ring, etc.

$L_1$ represents a divalent coupling group containing an aliphatic group, an aromatic group, a heterocyclic group, and/or a group comprising a combination of these groups. Preferable examples of divalent coupling groups are an alkylene group having from 1 to 10 carbon atoms, an arylene group having from 6 to 10 carbon atoms, an aralkylene group having from 7 to 10 carbon atoms, and a group comprising a combination of —O—, —S—, —CO—, —$NR_0$— ($R_0$ is hydrogen atom, an aliphatic group, an aromatic group, a heterocyclic group, or a hydroxyl group), —$SO_2$—, and an alkylene or arylene group. If possible, a combination of these groups may be used. Further, these divalent coupling groups may have a substituent. The groups and atoms mentioned above as examples of substituents of Ra may be employed as substituents of the divalent coupling groups. The following are specific examples, which are preferably used as $L_1$; a methylene group and an ethylene group are particularly preferable:

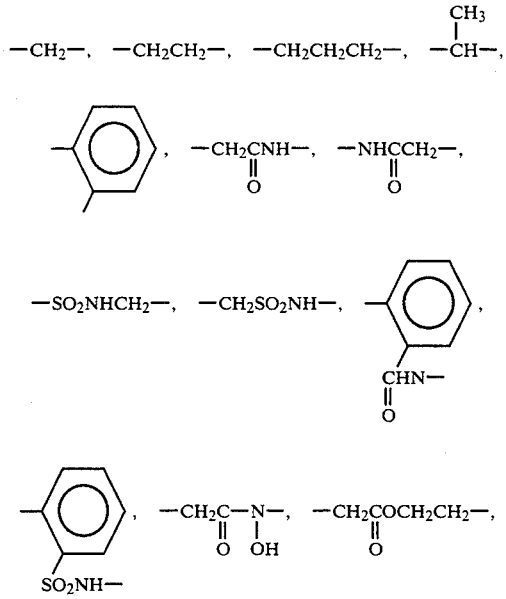

-continued

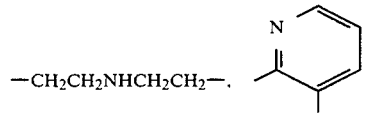

$R_{11}$ and $R_{12}$ each represent hydrogen atom, an aliphatic group, an aromatic group, or a heterocyclic group. Aliphatic groups represented by $R_{11}$ and $R_{12}$ are straight chain, branched or cyclic alkyl, alkenyl or alkynyl groups, which preferably have from 1 to 10 carbon atoms. More preferable examples of aliphatic groups are alkyl groups. An alkyl group having from 1 to 4 carbon atoms is particularly preferable. Aromatic groups represented by $R_{11}$ and $R_{12}$ are monocyclic or bicyclic aryl groups. Examples of such aryl groups are phenyl and naphthyl. Phenyl is more preferable. Examples of heterocyclic groups represented by $R_{11}$ and $R_{12}$ are the same as those represented by Ra in formula (1). In addition, $R_{11}$ and $R_{12}$ may each have a substituent. Examples of the substituent are the same as those mentioned above for Ra in formula (1). Further, it is preferable that at least either one of $R_{11}$ and $R_{12}$ be an alkyl, aryl or heterocyclic group having —OH—, —$COOM^1$, —$PO_3M^2M^3$, or —$SO_3M^4$ (wherein $M^1$, $M^2$, $M^3$ and $M^4$ which may be the same or different, each represent hydrogen atom or a cation, for example, an alkali metal (e.g., lithium, sodium, potassium, etc.), ammonium, or pyridinium), as a substituent. An alkyl, aryl or heterocyclic group having —$COOM^1$ as a substituent is more preferable.

If possible, $R_{11}$, $R_{12}$, X and $L_1$ may link together to form a ring.

Among the compounds represented by formula (1), those which are represented by the following formulae (11), (12) or (13) are preferable.

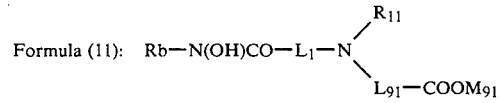

Formula (11): $Rb—N(OH)CO—L_1—N(R_{11})(L_{91}—COOM_{91})$

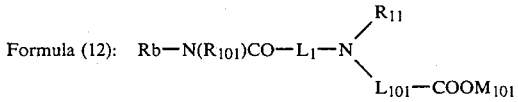

Formula (12): $Rb—N(R_{101})CO—L_1—N(R_{11})(L_{101}—COOM_{101})$

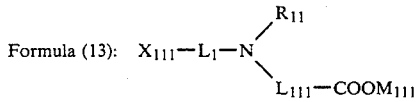

Formula (13): $X_{111}—L_1—N(R_{11})(L_{111}—COOM_{111})$ wherein $R_{11}$, Rb and $L_1$ are the same as those in formula (1); $L_{91}$, $L_{101}$ and $L_{111}$ are the same as $L_1$ in formula (1); $R_{101}$ is the same as Rb in formula (1); $M_{91}$, $M_{101}$ and $M_{111}$ each represent hydrogen atom or a cation (e.g., an alkali metal, ammonium, pyridinium, etc.); and $X_{111}$ represents —$SO_2NRe(Rf)$ or —$N(Rg)SO_2Rh$ (Re, Rf, Rg and Rh are the same as those in formula (1)).

Among the compounds represented by formula (11), those which are represented by the following formula (14) or (15) are more preferable.

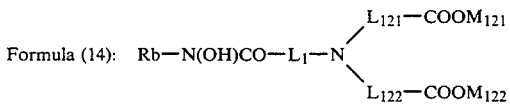

Formula (14): $Rb—N(OH)CO—L_1—N(L_{121}—COOM_{121})(L_{122}—COOM_{122})$

-continued

Formula (15):

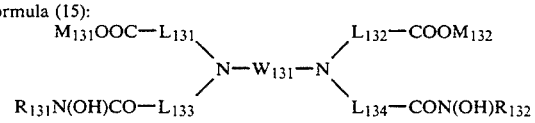

wherein Rb and $L_1$ are the same as those in formula (1); $L_{121}$, $L_{122}$, $L_{131}$, $L_{132}$, $L_{133}$ and $L_{134}$ are the same as $L_1$ in formula (1); $R_{131}$ and $R_{132}$ are the same as Rb in formula (1); $M_{121}$, $M_{122}$, $M_{131}$ and $M_{132}$ each represent hydrogen atom or a cation (e.g., an alkali metal, ammonium, pyridinium, etc.); and $W_{131}$ represents a divalent coupling group containing an alkylene group and/or an arylene group. Examples of preferable divalent coupling groups are an alkylene group having from 2 to 8 carbon atoms, an arylene group having from 6 to 10 carbon atoms, an aralkylene group having from 7 to 10 carbon atoms, a cycloalkane group having from 5 to 10 carbon atoms, a heterocyclic group, $-(W^1-O-)_{a_1}-W^2-$, and $-(W^1-S-)_{a_1}-W^2-$ (wherein $W^1$ and $W^2$ each represent an alkylene group, an arylene group, an aralkylene group, or a heterocyclic group; and $a_1$ represents 1, 2 or 3), $-W_1-N(D)-W^2$ (wherein D represents hydrogen, hydrocarbon, $-La-COOM_{a1}$, $-La-PO_3M_{a2}M_{a3}$, $-La-OH$, $-La-SO_3M_{a4}$ (La represents an alkylene group having from 1 to 8 carbon atoms, an arylene group having from 6 to 10 carbon atoms, an aralkylene group having from 7 to 10 carbon atoms, or a heterocyclic group; and $M_{a1}$, $M_{a2}$, $M_{a3}$, and $M_{a4}$ each represent hydrogen atom or a cation (e.g., an alkali metal, ammonium, pyridinium, etc.)). In addition, a combination of these divalent coupling groups is usable. These divalent coupling groups may have a substituent. Examples of the substituent are the same as those mentioned above for Ra in formula (1). The following are specific examples of $W_{131}$:

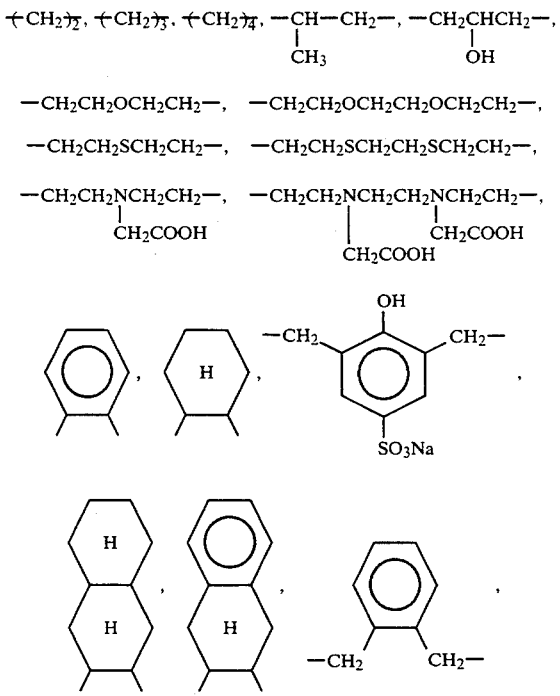

-continued

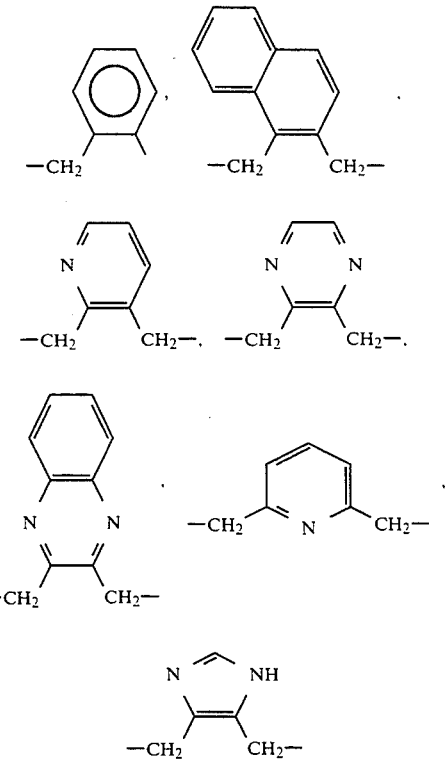

Among the compounds represented by formula (12), those which are represented by the following formula (16) or (17) are more preferable.

Formula (16): 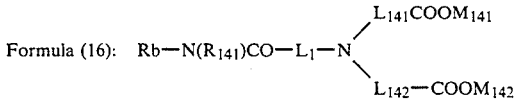

Formula (17):

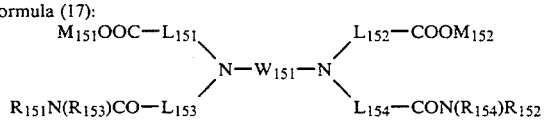

wherein Rb and $L_1$ are the same as those in formula (1); $L_{141}$, $L_{142}$, $L_{151}$, $L_{152}$, $L_{153}$ and $L_{154}$ are the same as $L_1$ in formula (1); $R_{141}$, $R_{151}$, $R_{152}$, $R_{153}$ and $R_{154}$ are the same as Rb in formula (1); $M_{141}$, $M_{142}$, $M_{151}$ and $M_{152}$ each represent hydrogen atom or a cation (e.g., an alkali metal, ammonium, pyridinium, etc.); and $W_{151}$ is the same as $W_{131}$ in formula (15).

Among the compounds represented by formula (13), those which are represented by the following formula (18) or (19) are more preferable.

Formula (18): 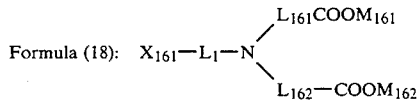

Formula (19): 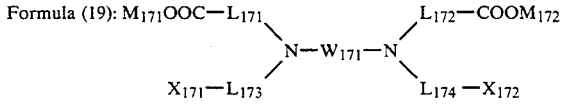

wherein $L_1$ is the same as that in formula (1); $L_{161}$, $L_{162}$, $L_{171}$, $L_{172}$, $L_{173}$ and $L_{174}$ are the same as $L_1$ in formula (1); $M_{161}$, $M_{162}$, $M_{171}$ and $M_{172}$ each represent hydrogen atom or a cation (e.g., an alkali metal, ammonium, pyridinium, etc.); $W_{171}$ is the same as $W_{131}$ in formula (15); and $X_{161}$, $X_{171}$ and $X_{172}$ are the same as $X_{111}$ in formula (13).

Next, the compounds represented by formula (2) will be explained below more specifically. In formula (2), $R_{21}$ and $R_{22}$ are the same as $R_{11}$ in formula (1). Z is the same as Ra in formula (1), which represents a heterocyclic group. Further, m represents 0 or 1.

$L_2$ represents a divalent coupling group. Preferable divalent coupling groups are straight chain, branched or cyclic alkylene, alkenylene or alkynylene (preferably having from 1 to 10 carbon atoms, more preferably an alkylene group having from 1 to 10 carbon atoms, and particularly preferably an alkylene group having from 1 to 4 carbon atoms), an arylene group (preferably having from 6 to 10 carbon atoms, e.g., a phenylene group or a naphthalene group, the former being more preferable), an aralkylene group (preferably having from 7 to 10 carbon atoms), —CO—. —$SO_2$—, or a group comprising a combination of —O—, —S—, —CO—, —N($R_{2a}$)— ($R_{2a}$ is hydrogen atom, an aliphatic group, an aromatic group, a heterocyclic group, or a hydroxyl group), —$SO_2$—, and an alkylene, arylene or heterocyclic group. If possible, a combination of these groups may be used. Further, these divalent coupling groups may have a substituent. Examples of the substituent are the same as those mentioned above for Ra. The following are preferable examples of $L_2$:

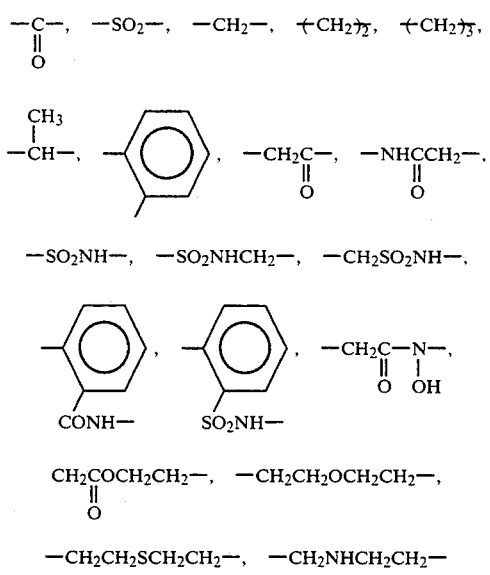

If possible, $R_{21}$, $R_{22}$, Z and $L_2$ may link together to form a ring.

Among the compounds represented by formula (2), those which are represented by the following formula (20) or (21) are preferable.

Formula (20): 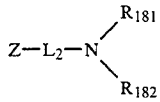

-continued

Formula (21): 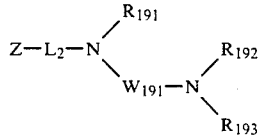

wherein Z and $L_2$ are the same as those in formula (2); $W_{191}$ is the same as $W_{131}$ in formula (15); $R_{181}$ and $R_{182}$ are the same as $R_{11}$ in formula (1); and $R_{181}$, $R_{182}$ and Z—$L_2$ may be the same or different.

Preferable examples of $R_{181}$ and $R_{182}$ are —Lb—OH, —Lb—$COOM_{b1}$, —Lb—$PO_3M_{b2}M_{b3}$, —Lb—$SO_3M_{b4}$ ($M_{b1}$, $M_{b2}$, $M_{b3}$ and $M_{b4}$ each represent hydrogen atom or a cation, for example, an alkali metal (e.g., lithium, sodium, potassium, etc.), ammonium, pyridinium, etc.; and Lb is the same as $L_1$ in formula (1)), and —Lb'—Za (Lb' is the same as $L_2$ in formula (2); and Za is the same as Z in formula (2)). More preferable examples are —Lb'—$COOM_{b1}$ and —Lb'—$Z_a$.

Further, $R_{191}$, $R_{192}$, $R_{193}$ and Z—$L_2$ in formulae (20) and (21) may be the same of different. It is preferable that at least one of $R_{191}$, $R_{192}$ and $R_{193}$ be Zb—Lc (Lc is the same as $L_2$ in formula (2); and Zb is the same as Z in formula (2)).

Among the compounds represented by formula (20), those which are represented by the following formula (22) are more preferable.

Formula (22): 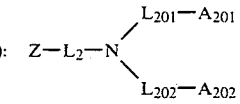

wherein Z and $L_2$ are the same as those in formula (2); $L_{201}$ and $L_{202}$ are the same as $L_1$ in formula (1); and $A_{201}$ and $A_{202}$ are the same as $A_{31}$ in formula (3).

Among the compounds represented by formula (21), those which are represented by the following formula (23) are more preferable.

Formula (23): 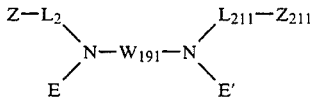

wherein Z and $L_2$ are the same as those in formula (2); $W_{191}$ is the same as $W_{131}$ in formula (15); $L_{211}$ is the same as $L_2$ in formula (2); $Z_{211}$ is the same as Z in formula (2); E and E' each represent hydrogen atom or —$L_{212}$—$A_{212}$ ($L_{212}$ is the same as $L_2$ in formula (2); and $A_{212}$ is the same as $A_{31}$ in formula (3)).

Next, the compounds represented by formula (3) will be explained more specifically.

$L_3$ is the same as $L_1$ in formula (1). $A_{31}$ represents a carboxyl group, a phosphono group, a sulfo group, or a hydroxyl group, preferably a carboxyl group or a hydroxyl group, and more preferably a carboxyl group. Aliphatic, aromatic and heterocyclic groups represented by $R_{31}$, $R_{32}$, $R_{33}$, $R_{34}$, $R_{35}$, $R_{36}$, $R_{37}$, $R_{38}$ and $R_{39}$ are the same as those represented by $R_{11}$ in formula (1).

Acyl, sulfamoyl, carbamoyl, alkoxycarbonyl, aryloxycarbonyl, sulfonyl and sulfinyl groups represented by $R_{38}$ and $R_{39}$ preferably have 10 or less carbon atoms.

As $R_{31}$, $R_{32}$, $R_{33}$ and $R_{34}$, hydrogen atom is preferably used. It is preferable for $R_{38}$ and $R_{39}$ to be cis. Further, $R_{38}$ and $R_{39}$ may link together to form a ring.

In addition, p and q each represent 0 or 1. Preferably, at least either one of p and q is 1. More preferably, both p and q are 1.

Among the compounds represented by formula (3), those which are represented by the following formula (24) are preferable.

Formula (24):

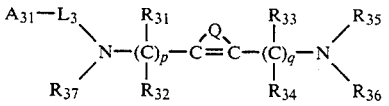

wherein $A_{31}$, $L_3$, $R_{31}$, $R_{32}$, $R_{33}$, $R_{34}$, $R_{35}$, $R_{36}$, $R_{37}$, p and q are the same as those in formula (3).

In formula (24), Q represents a non-metallic atom group forming a five- or six-membered ring. Examples of five- or six-membered rings formed of Q are an aromatic group (e.g., benzene, naphthalene, phenanthrene, anthracene, etc.), a heterocyclic group (e.g., pyridine, pyrazine, pyrimidine, pyridazine, thiophene, furan, pyran, pyrrole, imidazole, pyrazole, isothiazole, isooxazole, thianthrene, isobenzofuran, chromene, xanthene, phenoxthine, indolizine, isoindole, indole, indazole, quinolizine, isoquinoline, quinoline, phthalazine, naphthyridine, quinoxaline, quinazoline, cinnoline, pteridine, carbazole, carboline, phenanthridine, acridine, pteridine, phenanthroline, phenazine, phenothiazine, phenoxazine, chroman, pyrroline, pyrazoline, indoline, isoindoline, etc.), and a cyclic alkene (e.g., cyclopentene, cyclohexene, etc.). These rings may form a fused ring with another ring. Preferable examples of rings formed of Q include benzene, naphthalene, pyridine, imidazole, pyrazine, pyrimidine, quinoline, and quinoxaline. More preferable rings are benzene and imidazole. Rings formed of Q may have a substituent. Examples of the substituent are the same as those mentioned above for Ra in formula (1).

Among the compounds represented by formula (3), those which are represented by the following formula (25) are more preferable.

Formula (25):

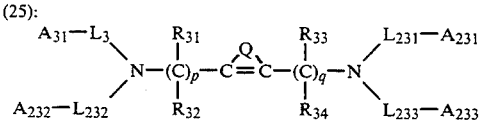

wherein $A_{31}$, $L_3$, $R_{31}$, $R_{32}$, $R_{33}$, $R_{34}$, p and q are the same as those in formula (3); $L_{231}$, $L_{232}$ and $L_{233}$ are the same as $L_3$ in formula (3); $A_{231}$, $A_{232}$ and $A_{233}$ are the same as $A_{31}$ in formula (3); and Q is the same as Q in formula (24).

Next, the compounds represented by formula (4) will be explained more specifically. In formula (4), $A_{41}$, $A_{42}$ and $A_{43}$ are the same as $A_{31}$ in formula (3). $L_{41}$, $L_{42}$ and $L_{43}$ are the same as $L_1$ in formula (1). Y represents oxygen or sulfur atom. Further, s, t, u, and v each represent 0 or 1. In addition, a represents 0, 1, 2, 3 or 4. $R_{41}$ represents a substituent. Examples of the substituent are the same as those mentioned above for Ra in formula (1).

Among the compounds represented by formula (4), those which are represented by the following formula (26) are preferable.

Formula (26):

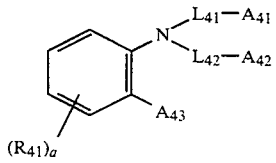

wherein $A_{41}$, $A_{42}$, $A_{43}$, $L_{41}$, $L_{42}$, $R_{41}$, and a are the same as those in formula (4 ).

Next, the compounds represented by formula (5) will be explained more specifically. In formula (5), $X_{51}$, $X_{52}$, $X_{53}$ and $X_{54}$ each represent hydrogen atom, an aliphatic group, an aromatic group, a heterocyclic group (the aliphatic, aromatic and heterocyclic groups are the same as those represented by $R_{11}$ in formula (1)), or $-L_{51}-A_{51}$ ($L_{51}$ is the same as $L_1$ in formula (1); $A_{51}$ represents a carboxyl group, a phosphono group, a sulfo group, a hydroxyl group, a carbonamide group, a carbamoyl group, a sulfonamide group, a sulfamoyl group, a hydroxamic acid group, an alkoxy group, or an alkylthio group, preferably a carboxyl group or a hydroxyl group, and more preferably a carboxyl group; $A_{51}$ may have a substituent, examples of which are the same as those mentioned above for Ra in formula (1); and if $A_{51}$ has carbon atoms, the number of carbons is preferably not greater than 10, more preferably not greater than 6). Alternatively, $X_{51}$, $X_{52}$, $X_{53}$ and $X_{54}$ in formula (5) each represent the following formula (27).

Formula (27):

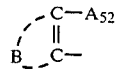

wherein B represents a group of atoms necessary for forming an aryl group or a heterocyclic group.

An aryl group formed of B is preferably a monocyclic or bicyclic aryl group, for example, a phenyl group or a naphthyl group. A more preferable aryl group is phenyl. A heterocyclic group formed of B is a saturated or unsaturated heterocyclic group comprising from 3 to 10 members including at least one of N, O and S atoms. Such a heterocyclic group may be a monocyclic ring or a fused ring formed in combination with another aromatic or heterocyclic ring. Preferable heterocyclic groups which may be formed of B are five- or six-membered aromatic heterocyclic groups, for example, thiophene, furan, pyrrole, imidazole, pyrazole, pyridine, pyrazine, pyrimidine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, oxazole, etc. More preferable examples of aromatic heterocyclic groups are pyrrole, imidazole, pyrazole, pyridine, pyrazine, pyrimidine, triazole, thiadiazole, oxadiazole, quinoxaline, tetrazole, thiazole, and oxazole. Particularly preferable aromatic heterocyclic groups are pyrrole, imidazole, pyridine, triazole, thiadiazole, oxadiazole, quinoxaline, tetrazole, thiazole, and oxazole. Aryl or heterocyclic groups formed of B may have a substituent. Examples of the substituent are the same as those mentioned above for Ra in formula (1).

$A_{52}$ represents a carboxyl group, a phosphono group, a sulfo group, a hydroxyl group, a carbonamide group, a carbamoyl group, a sulfonamide group, a sulfamoyl group, a hydroxamic acid group, an alkoxy group, an alkylthio group, or an amino group. When $A_{52}$ has carbon atoms, the number of carbon atoms is preferably not greater than 10, more preferably not greater than 6. Preferable examples of $A_{52}$ are a carboxyl group, a phosphono group, a sulfo group, and a hydroxyl group. A more preferable example of $A_{51}$ is a carboxyl group.

$W_{51}$ is the same as $W_{131}$ in formula (15).

It should be noted that at least one of $X_{51}$, $X_{52}$, $X_{53}$ and $X_{54}$ represents the above-described formula (27).

Among the compounds represented by formula (5), those which are represented by the following formula (28) or (29) are preferable.

Formula (28):

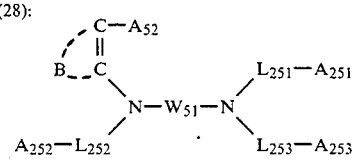

Formula (29):

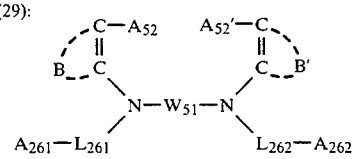

wherein $A_{52}$, B and $W_{51}$ are the same as those in formula (5); $A_{52}'$ is the same as $A_{52}$ in formula (5); B' is the same as B in formula (5); $L_{251}$, $L_{252}$, $L_{253}$, $L_{261}$ and $L_{262}$ are the same as $L_1$ in formula (1); and $A_{251}$, $A_{252}$, $A_{253}$, $A_{261}$ and $A_{262}$ are the same as $A_{51}$ in formula (5).

Next, the compounds represented by formula (7) will be explained more specifically. In formula (7), $W_{61}$ represents a divalent coupling group containing a thioether group, an alkylene group, and/or an arylene group. The divalent coupling group represented by $W_{61}$ may have a substituent. Examples of the substituent are the same as those mentioned above for Ra in formula (1). The total number of carbon atoms of the divalent coupling group represented by $W_{61}$ is preferably in the range of from 2 to 20, more preferably from 2 to 8, and further preferably from 2 to 4. Preferable examples of the divalent coupling group represented by $W_{61}$ are groups represented by $—W^{b1}—S—(W^{b2}—S—)_d—W^{b3}—$ ($W^{b1}$, $W^{b2}$ and $W^{b3}$ each represent an alkylene group and/or an arylene group, more preferably an alkylene group, and particularly preferably a nonsubstituted alkylene group; the total number of carbon atoms of the alkylene and/or allylene group represented by $W^{b1}$, $W^{b2}$ and $W^{b3}$ is preferably in the range of from 2 to 20, more preferably from 2 to 6; particularly preferable examples of $W^{b1}$, $W^{b2}$ and $W^{b3}$ are an ethylene group and a trimethylene group; and d represents 0, 1 or 2, preferably 0 or 1, and more preferably 0).

$L_{61}$, $L_{62}$, $L_{63}$ and $L_{64}$ each represent an alkylene group independently, preferably an alkylene group having from 1 to 4 carbon atoms. More preferable examples of $L_{61}$, $L_{62}$, $L_{63}$ and $L_{64}$ are a methylene group and an ethylene group. Methylene is particularly preferable.

$A_{61}$, $A_{62}$, $A_{63}$ and $A_{64}$ each represent a carboxyl group, a phosphono group, a sulfo group, or a hydroxyl group independently. Preferable examples of $A_{61}$, $A_{62}$, $A_{63}$ and $A_{64}$ are a carboxyl group and a hydroxyl group, the former being particularly preferable.

Next, the compounds represented by formula (8) will be explained more specifically. In formula (8), $W_{71}$ represents an alkylene group having 4 or more carbon atoms in total, preferably from 4 to 20 carbon atoms in total, and more preferably from 4 to 8 carbon atoms in total. $W_{71}$ may have a substituent, examples of which are the same as those mentioned above for Ra in formula (1).

$L_{71}$, $L_{72}$, $L_{73}$ and $L_{74}$ are the same as $L_{61}$, $L_{62}$, $L_{63}$ and $L_{64}$ in formula (7). $A_{71}$, $A_{72}$, $A_{73}$ and $A_{74}$ are the same as $A_{61}$, $A_{62}$, $A_{63}$ and $A_{64}$ in formula (7).

Next, the compounds represented by formula (9) will be explained more specifically. In formula (9), J represents hydrogen atom or a hydroxyl group, preferably hydrogen atom. $M_8$ represents hydrogen atom or a cation (e.g., an alkali metal, ammonium, etc.). Further, x represents 0 or 1, preferably 1. $G_{81}$ and $G_{82}$ each represent an aliphatic, aromatic or heterocyclic group having a hydroxyl group, a carboxyl group, a phosphono group, a sulfo group, an amino group, or an ether group as a substituent.

Aliphatic groups represented by $G_{81}$ and $G_{82}$ are straight chain, branched or cyclic alkyl, alkenyl or alkynyl groups preferably having from 1 to 10 carbon atoms. More preferable aliphatic groups are alkyl groups. An alkyl group having from 1 to 4 carbon atoms is particularly preferable.

Aromatic groups represented by $G_{81}$ and $G_{82}$ are monocyclic or bicyclic aryl groups, for example, a phenyl group, a naphthyl group, etc. Phenyl is more preferable.

Heterocyclic groups represented by $G_{81}$ and $G_{82}$ are saturated or unsaturated heterocyclic groups comprising from 3 to 10 members including at least one of N, O and S atoms. The heterocyclic groups may be monocyclic rings or fused rings formed in combination with another aromatic or heterocyclic ring. Preferable heterocyclic groups are five- or six-membered aromatic heterocyclic groups, for example, thiophene, furan, pyrrole, imidazole, pyrazole, pyridine, pyrazine, pyrimidine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, oxazole, etc. More preferable examples of aromatic heterocyclic groups are pyrrole, imidazole, pyrazole, pyridine, pyrazine, pyrimidine, triazole, thiadiazole, oxadiazole, quinoxaline, tetrazole, thiazole, and oxazole. Particularly preferable examples are pyrrole, imidazole, pyridine, triazole, thiadiazole, oxadiazole, quinoxaline, tetrazole, thiazole, and oxazole.

Further, aliphatic, aromatic or heterocyclic groups represented by $G_{81}$ and $G_{82}$ may have a substituent other than a hydroxyl group, a carboxyl group, a phosphono group, a sulfo group, an amino group, or an ether group. Examples of the substituent are the same as those mentioned above for Ra in formula (1).

Among the compounds represented by formula (9), those which are represented by the following formula (30) are preferable.

Formula (30): $(M_{271}OOCCH_2)_y—N(CH_2\overset{\overset{J}{|}}{(CH)}_xCOOM_{272})_z$ wherein J and x are the same as those in formula (9); $M_{271}$ and $M_{272}$ each represent hydrogen atom or a cation; y represents 0, 1 or 2; z represents 1, 2 or 3; the sum of y and z is 3; y is preferably 2; and z is preferably 1.

Specific examples of the compounds represented by formulae (1), (2), (3), (4), (5), (7), (8) and (9) and synthesizing methods therefor are described in Japanese Patent Application Laid-Open (KOKAI) Nos. 63-97,953 (1988), 63-97,954 (1988), 1-93,740 (1989), and 3-148,243 (1991), and Japanese Patent Application Nos. 2-119,250 (1990), 2-127,479 (1990), 2-156,683 (1990), 2-175,026 (1990), 2-196,972 (1990), 2-201,846 (1990), 2-258,539 (1990), 2-330,775 (1990), 2-330,776 (1990), 2-330,777 (1990), 3-157,442 (1991), 3-175,708 (1991), 3-180,524 (1991), 3-189,555 (1991), 3-175,708 (1991), 3-193,680 (1991), and 3-253,775 (1991).

Typical examples (1-1) to (1-54) of the compounds represented by formulae (1), (2), (3), (4), (5), (7), (8) and (9) will be shown below for illustrative purposes only, but the present invention is not limited to these examples.

1-1

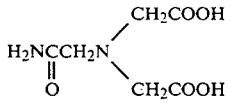

1-2

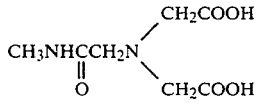

1-3

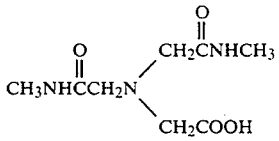

1-4

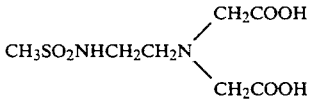

1-5

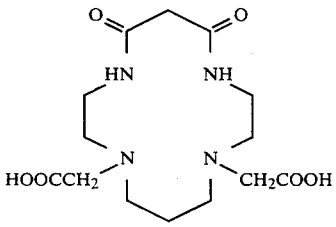

1-6

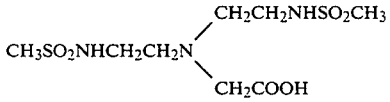

1-7

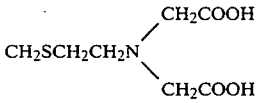

1-8

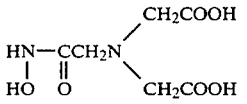

1-9

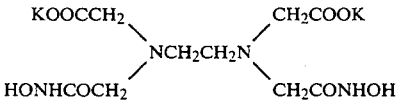

-continued 1-10

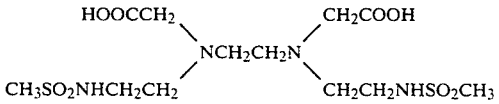

1-11

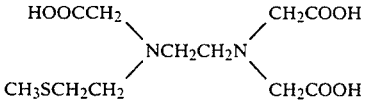

1-12

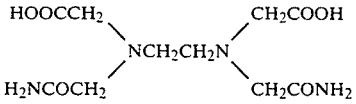

1-13

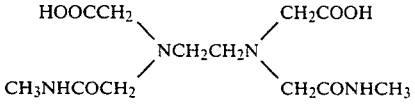

1-14

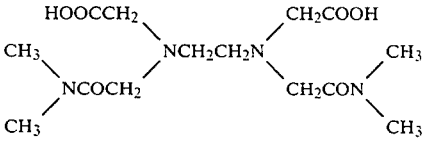

1-15

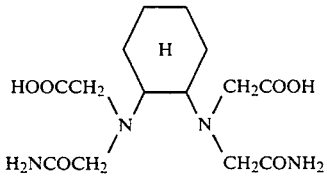

1-16

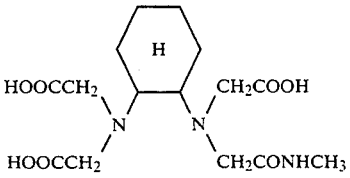

1-17

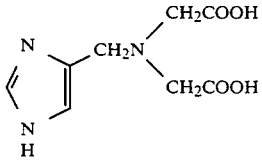

1-18

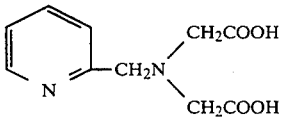

1-19

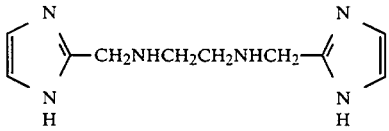

1-20

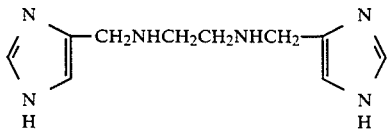

-continued
1-21
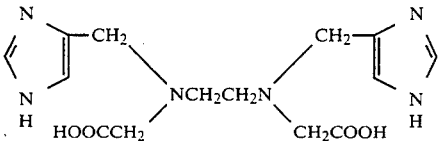
1-22
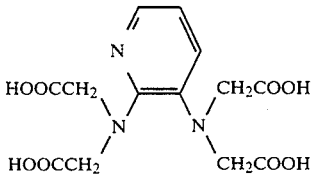
1-23
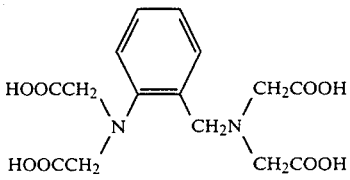
1-24
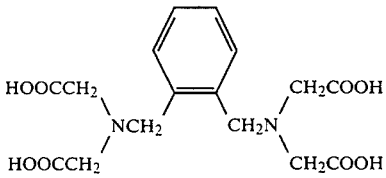
1-25
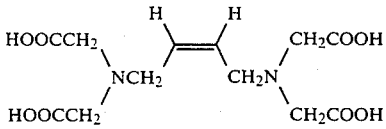
1-26
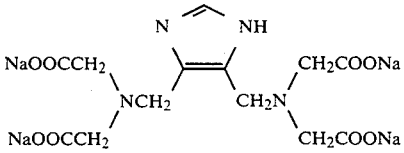
1-27
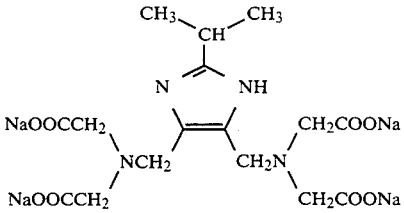
1-28
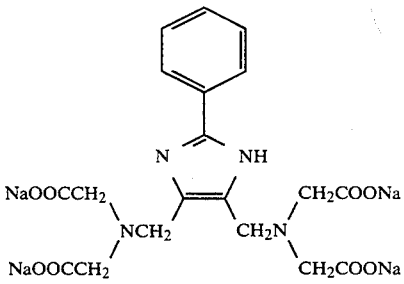
-continued
1-29
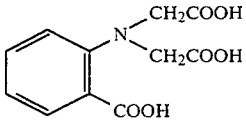
1-30
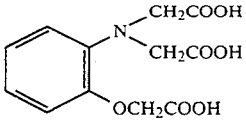
1-31
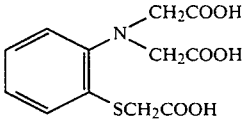
1-32
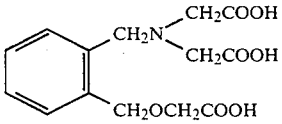
1-33
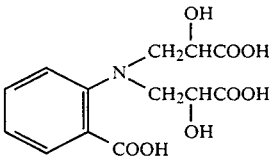
1-34
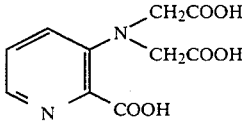
1-35
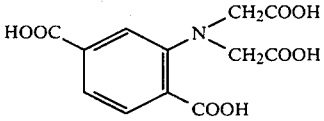
1-36
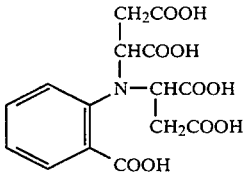
1-37
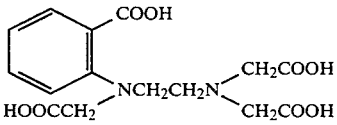
1-38
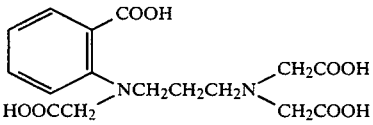
1-39
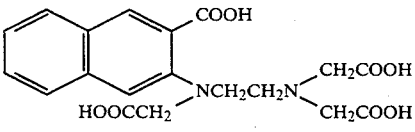

-continued 1-40

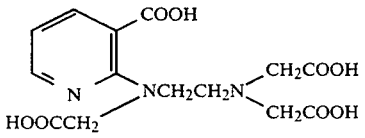

1-41

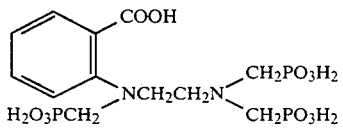

1-42

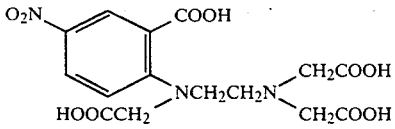

1-43

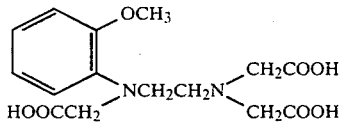

1-44

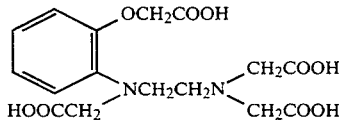

1-45

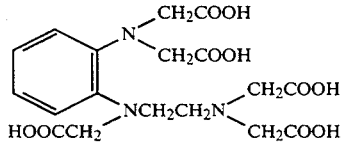

1-46

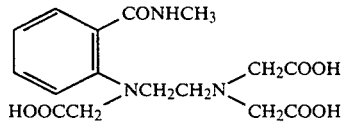

1-47

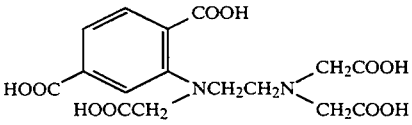

1-48

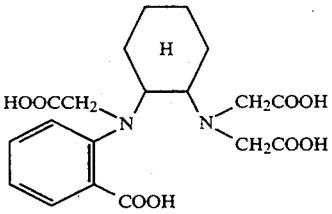

-continued 1-49

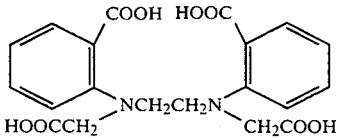

1-50

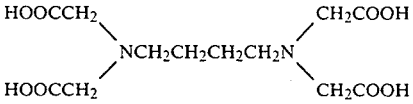

1-51

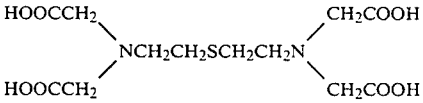

1-52

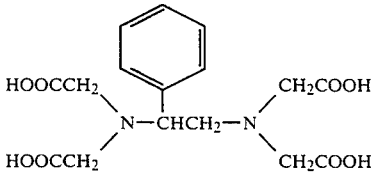

1-53

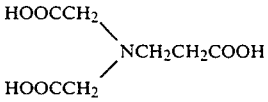

1-54

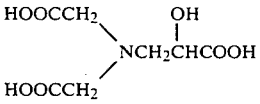

In use of a ferric chelate compound of at least one amino compound selected from among those represented by the above-described formulae (1), (2), (3), (4), (5), (7), (8) and (9), the amount of ferric chelate compound used depends on the desired reduction range, the kind of photosensitive material used, the density of the silver image concerned, etc., but it is usually in the range of from 0.3 g per liter to the solubility limit, preferably from 5 g to 50 g per liter.

The reducer of the present invention is basically an aqueous solution of a ferric chelate compound of at least one amino compound selected from among those represented by the above-described formulae (1), (2), (3), (4), (5), (7), (8) and (9). It is also possible to use a mercapto compound as described in Japanese Patent Application Laid-Open (KOKAI) No. 52-68419 (1977), or 2-mercapto-1,3,4-triazole, 2-(2-dimethylaminoethyl)thio-5-mercapto-thiadiazole in combination with such a ferric chelate compound. However, it is preferable to use a compound of the above-described formula (10) as a reduction accelerator in combination with a ferric chelate compound of at least one amino compound selected from among those represented by the above-described formulae (1), (2), (3), (4), (5), (7), (8) and (9).

Specific examples (2-1) to (2-15) of the compounds represented by the above-described formula (10) will be shown below for illustrative purposes only, but the present invention is not limited to these examples.

2-1

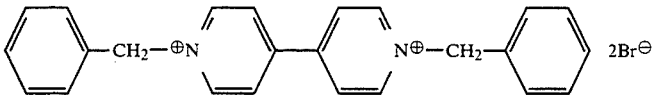

-continued
2-2
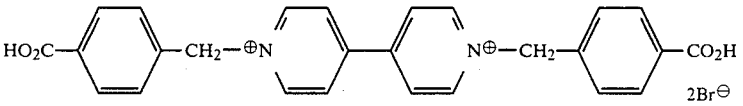
2-3
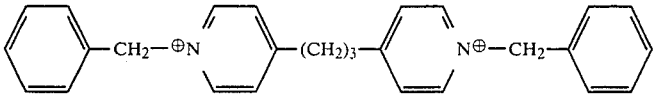
2-4
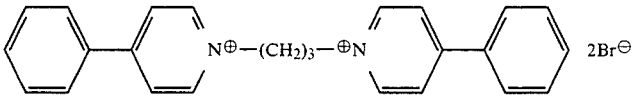
2-5
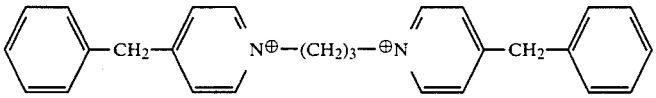
2-6
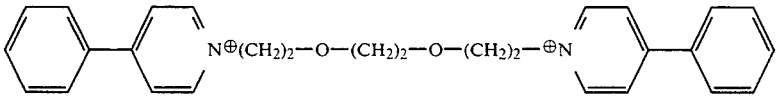
2-7
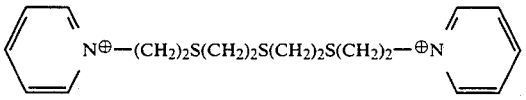
2-8
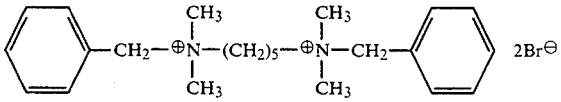
2-9
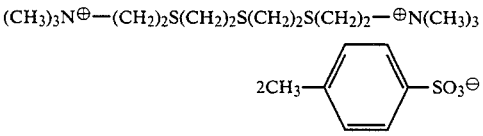
2-10
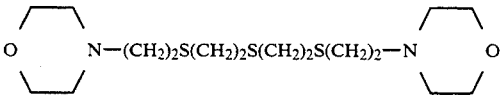
2-11
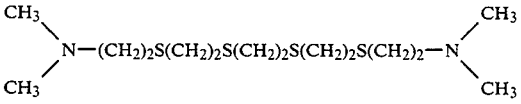
2-12
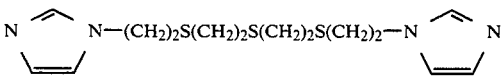

-continued 2-13

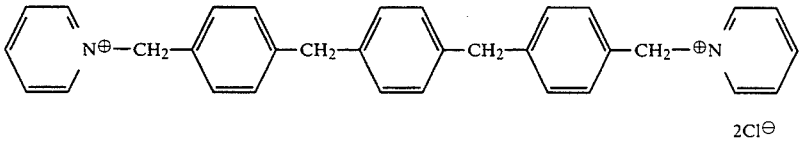

2-14

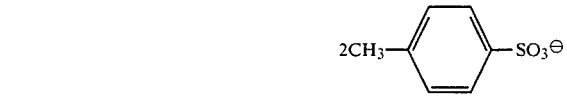

2-15

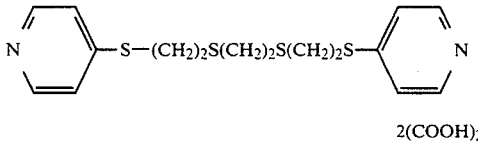

Among the above-described reduction accelerators, the compounds 2-1, 2-2, 2-3, 2-9, 2-10 and 2-11 are particularly preferable.

The amount of compound of formula (10) used depends on the desired reduction range, the kind of photosensitive material used, etc., but it is usually in the range of from 0.001 g to 3.0 g per liter, preferably from 0.01 g to 0.5 g per liter. The accelerators of formula (10) may be used alone or in combination.

Although the reducer of the present invention is basically an aqueous solution of a ferric chelate compound of at least one amino compound selected from among those represented by the above-described formulae (1), (2), (3), (4), (5), (7), (8) and (9), it is preferable to use a complex-forming agent and a dye in combination with the reducer.

Examples of dyes usable in the reducer of the present invention are water-soluble compounds such as styryl dyes, oxonol dyes, anthraquinone dyes, merocyanine dyes, cyanine dyes, triarylmethane dyes, azomethine dyes, azo dyes, metal complex dyes, etc. From the viewpoint of safety in the reducer, metal complex dyes, anthraquinone dyes, and triarylmethane dyes are suitably used. With regard to the hue, blue is preferable.

Specific examples (3-1) to (3-8) of water-soluble dyes effectively used in the reducer of the present invention will be shown below.

3-1

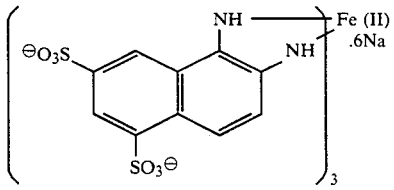

3-2

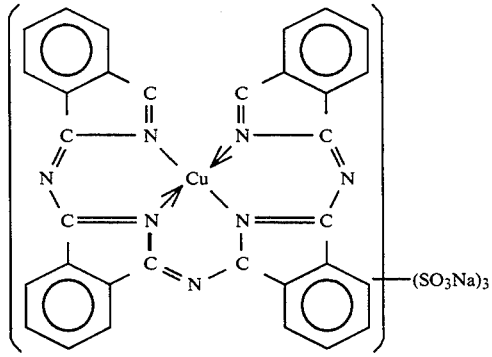

3-3

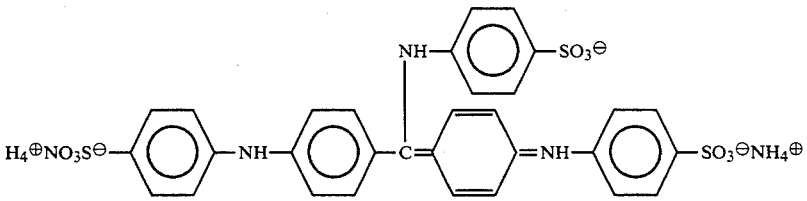

-continued 3-4

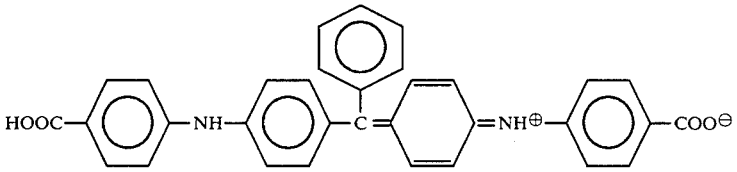

3-5

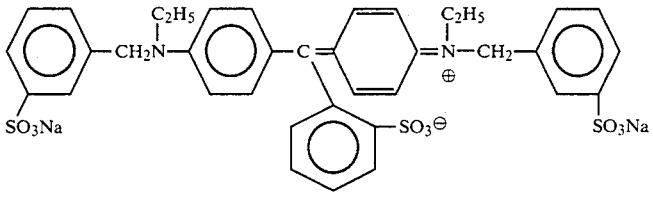

3-6

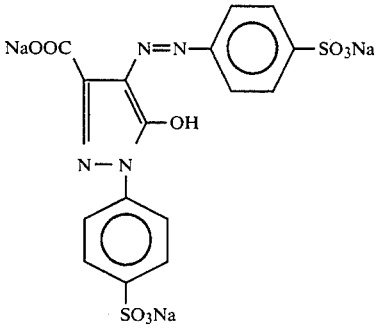

3-7

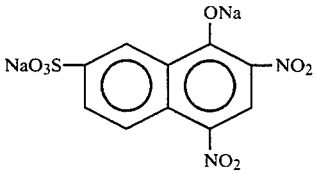

3-8

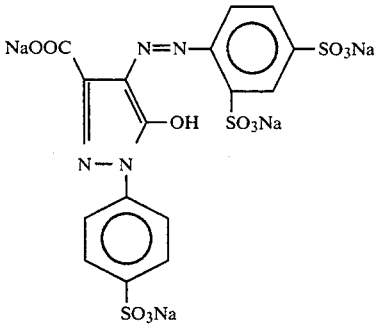

The amount of water-soluble dye used in the present invention depends on the kind of dye used, the end use, etc., but it is generally in the range of from $10^{-4}$ g to 5 g per liter, preferably from $10^{-2}$ g to 1.0 g per liter.

Examples of complex-forming agents usable in the reducer are known silver halide solvents such as sodium thiosulfate, ammonium thiosulfate, ammonium thiocyanate, thiourea, a halide, a thioether, etc. The amount of complex-forming agent used is in the range of from 5 g to 200 g per liter, preferably from 10 g to 100 g per liter.

In the reducer of the present invention, a complex-forming agent and a dye may be used in combination with a ferric chelate compound of at least one amino compound selected from among those represented by the above-described formulae (1), (2), (3), (4), (5), (7), (8) and (9) and a compound of formula (10) as a reduction accelerator, as a matter of course.

Further, the reducer of the present invention may contain other additives, for example, a pH buffering agent, a preservative such as a sulfite, a halide, etc., according to need. If necessary, the reducer of the present invention may contain a surface-active agent, and a thickening agent.

In the present invention, a silver image is reduced by dipping it in the reducer. It is also possible to reduce a silver image by touching it with a sheet formed by impregnating the reducer of the present invention into a hydrophilic binder such as gelatin, polyvinyl alcohol, or polyacrylic acid and coating it on a substrate.

If a silver image is pretreated with a liquid containing sodium sulfate, ammonium thiosulfate, sodium sulfite, or a sodium thiosulfate prior to the reduction treatment with the reducer of the present invention, the effectiveness of the reducer can be enhanced.

The pH value of the reducer according to the present invention is preferably in the range of from 2 to 8.

There is no particular restriction on the halogen composition of a silver halide photosensitive material to which the image reducing method of the present invention is applied. The halogen composition may contain silver chlorobromide, silver chloride, silver iodobromide, silver iodochlorobromide, or a mixture of two or more of these substances. The image reducing method of the present invention is particularly effective in the case of a halogen composition containing silver iodide (preferably a silver halide having a silver iodide content of from 0.05 mol % to 5 mol %, particularly from 0.1 mol % to 3 mol %).

Silver halide photographic emulsions which are usable in the present invention can be prepared by known processes described, for example, in Research Disclosure (RD) No. 17643 (Dec. 1978), pp. 22–23, "I. Emulsion Preparation and Types", and ibid., No. 18716 (Nov. 1979), p. 648. In the present invention, it is also possible to use tabular grains such as those described in U.S. Pat. Nos. 4,434,226 and 4,439,529, and Research Disclosure No. 122534 (January 1983).

Various additives for photography which are usable in the present invention are described, for example, in the above-mentioned Research Disclosure Nos. 17643 (pp. 23–28) and 18716 (pp. 648–651). Table below shows the kinds of additive described in the above-mentioned literatures and the pages and columns where these additives are described in detail.

| Additives | RD 17643 | RD 18716 |
|---|---|---|
| 1. Chemical sensitizer | p.23 | p.648 right column (RC) |
| 2. Sensitivity increasing agent | | p.648, RC |
| 3. Spectral sensitizer supersensitizer | pp.23–24 | p.648, RC to p.649, RC |
| 4. Brightening agent | p.24 | |
| 5. Antifoggant and stabilizer | pp.24–25 | p.649, RC |
| 6. Light absorber filter dye, ultraviolet absorber | pp.25–26 | p.649, RC to p.650, left column (LC) |
| 7. Stain inhibitor | p.25, RC | p.650, LC to RC |
| 8. Hardening agent | p.26 | p.651, LC |
| 9. Binder | p.26 | p.651, LC |
| 10. Plasticizer, lubricant | p.27 | p.650, RC |
| 11. Coating aid, surface active agent | pp.26–27 | p.650, RC |
| 12. Antistatic agent | p.27 | p.650, RC |

There is no particular restriction on silver halide photosensitive materials to which the reduction method of the present invention can be applied. However, it is preferable to apply the method of the present invention to photosensitive materials for plate-making.

The reduction method of the present invention can also be applied to a photosensitive material treated with a lith developer. A typical lith developer basically comprises ortho- or para-dihydroxybenzene, an alkali agent, a small amount of free sulfite, sulfite ion buffer, etc. Hydroquinone is a practical ortho-or para-dihydroxybenzene used as a developing agent.

The reduction method of the present invention can be effectively applied, particularly to superhigh-contrast photosensitive materials containing a hydrazine derivative. Such photosensitive materials are described specifically, for example, in Japanese Patent Application Laid-Open (KOKAI) Nos. 53-16623 (1988), 53-20922 (1988), and 53-66732 (1988), and U.S. Pat. Nos. 4,224,401, 4,168,977, 4,166,742, 4,311,781, 4,272,606, 4,211,857, and 4,243,739.

The reduction method of the present invention can also be effectively applied to superhigh-contrast photosensitive materials containing a tetrazolium salt, which are described in Japanese Patent Application Laid-Open (KOKAI) Nos. 52-18317 (1977), 53-95628 (1988), and 53-95629 (1988).

These new high-contrast photosensitive materials have the advantage that high-contrast photographic characteristics can be obtained with a developer which is more stable than the lith developer. Such a developer contains a dihydroxybenzene developing agent as a main developing agent, and a p-aminophenol or 1-phenyl-3-pyrazolidone developing agent as an auxiliary developing agent. The developer may be contained in the photosensitive material. Examples of preservatives include sodium sulfite, potassium sulfite, sodium hydrogensulfite, formaldehyde sodium hydrogensulfite, etc.

The pH value of the developer is set in the range of from 10.5 to 12.3. As an alkali agent contained in the developer, an ordinary water-soluble inorganic alkali metal salt (e.g., sodium hydroxide, potassium carbonate, potassium tertiary phosphate, etc.) can be used. It is also possible to use an alkanolamine as described in U.S. Pat. No. 4,269,929.

Generally, the developer may further contain a pH buffering agent, e.g., boric acid, a development inhibitor, e.g., potassium bromide, potassium iodide, etc., an organic solvent, e.g., triethylene glycol, ethanol, etc., and an antifoggant such as a benztriazole compound, e.g., 5-methylbenztriazole, or an indazole compound, e.g., 5-nitroindazole. If necessary, the developer may further contain a toning agent, a surface-active agent, a water softening agent, etc.

With regard to a fixing solution, one having a conventional composition can be used. Examples of fixing agents usable in the present invention are a thiosulfate, a thiocyanate, and organic sulfur compounds which are known to be effective as fixing agents. The fixing solution may contain a water-soluble aluminum salt, e.g., aluminum sulfate, alum, etc., as a hardening agent. The amount of water-soluble aluminum salt used is usually from 0 to 3.0 g in terms of Al per liter. It is also possible to use an ethylenediaminetetraacetic acid Fe (trivalent) complex salt as an oxidizing agent.

The treating temperature is usually selected in the range of from 18° C. to 50° C., but it may be lower than 18° C. or higher than 50° C.

The present invention will be described below more specifically by way of Examples.

EXAMPLE 1

An aqueous silver nitrate solution and an aqueous solution of potassium iodide and potassium bromide were added simultaneously to an aqueous gelatin solution maintained at 50° C. in 60 minutes in the presence of $4\times10^{-7}$ mol of potassium iridium (trivalent) hexachloride per mol of silver, together with ammonium, while pAg was being maintained at 7.8, thereby preparing a cubic monodisperse emulsion having an average grain size of 0.28 μm and an average silver iodide content of 0.3 mol %.

After the emulsion was desalted by flocculation, an inert gelatin was added thereto in an amount of 40 g per mol of silver. Thereafter, with the temperature maintained at 50° C., 5,5'-dichloro-9-ethyl-3,3'-bis-(3-sulfopropyl) oxacarbocyanine was added to the emulsion as a sensitizing dye, and a KI solution was also added thereto in an amount of $10^{-3}$ mol per mol of silver. After 15 minutes had elapsed, the temperature was lowered.

Then, the emulsion was redissolved, and methylhydroquinone (0.02 mol per mol of Ag), the following sensitizing dye (1), the following hydrazine (2) ($1.2\times10^{-3}$ per mol of Ag), the following additive (3), 5-methylbenztriazole, 4-hydroxyl-1,3,3a,7-tetrazinedene, the following accelerators (4) and (5), a polyethyl acrylate dispersion, and a hardening agent were added to the emulsion at 40° C. Then, the resulting solution was coated on a polyethylene terephthalate film.

(1)

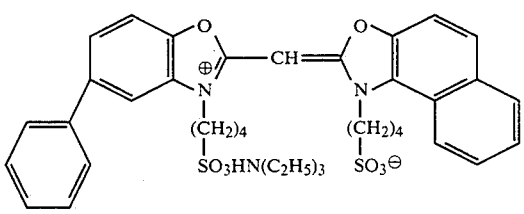

(2)

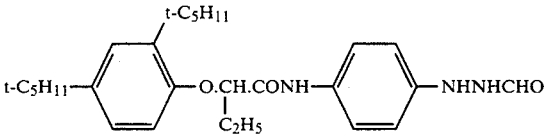

(3)

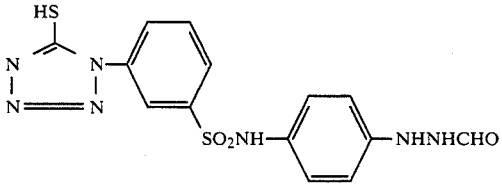

(4)

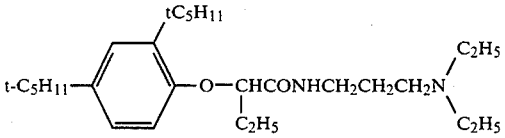

(5)

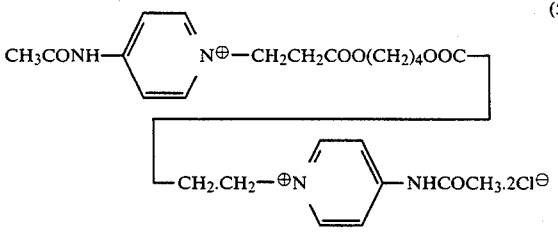

The film thus obtained was exposed through a wedge for sensitometry by using a 150-line contact screen. Thereafter, the exposed film was developed for 30 seconds at 34° C. with a developing solution having the following composition and then subjected to fixing, washing and drying.

| Developing solution: | |
|---|---|
| Tetrasodium ethylenediaminetetraacetate | 1 g |

-continued

| Developing solution: | |
|---|---|
| Sodium hydroxide | 18 g |
| 5-sulfosalicylic acid | 55 g |
| Potassium sulfite | 110 g |
| n-butyldiethanolamine | 15 g |
| N-methyl-p-aminophenol sulfate | 0.3 g |
| Hydroquinone | 50 g |
| 2-mercaptobenzimidazole-5-sulfonic acid | 0.3 g |
| Sodium 3-(5-mercaptotetrazole)benzene-sulfonate | 0.2 g |
| Sodium toluenesulfonate | 8.0 g |
| 5-methylbenztriazole | 0.5 g |
| Sodium bromide | 10 g |
| Water to make | 1 liter (pH: 11.6) |

As a fixing solution, GRF-1 (manufactured by Fuji Photo Film Co., Ltd.) was employed.

The dot silver image (dot percent: 50%) thus obtained was reduced with various reducers (with the pH adjusted to 6) each having a composition consisting essentially of 73 mmol/liter of a ferric chelate compound and 32 mmol/liter of sodium thiosulfate. The rate at which the dot percent reduced while the silver image density (4.60 or more) before the reducing treatment reduced to a density of 2.50, that is, the rate of change in dot percent from 50%, was obtained for each reducer, and residues were also investigated. The results are shown in Table 1 below.

TABLE 1

| Ferric chelate compound | Reduction range | Residue | Condition of reducer after 2 days elapsed | Remarks |
|---|---|---|---|---|
| 1. Ammonium (ethylenediamine-tetraaceto) ferric chelate | 2% | Yellowish brown Ring around each dot | No precipitate | Comp. Example |
| 2. Ammonium (1,3-diamino-propanetetraaceto) ferric chelate | 10% | None | Precipitate separated out | Comp. Example |
| 3. Ammonium ferric chelate of compound 1-1 | 11% | None | No precipitate | Present invention |
| 4. Ammonium ferric chelate of compound 1-4 | 10% | None | No precipitate | Present invention |
| 5. Ammonium ferric chelate of compound 1-9 | 10% | None | No precipitate | Present invention |
| 6. Ammonium ferric chelate of compound 1-10 | 10% | None | No precipitate | Present invention |
| 7. Ammonium ferric chelate of compound 1-12 | 12% | None | No precipitate | Present invention |
| 8. Ammonium ferric chelate of compound 1-13 | 11% | None | No precipitate | Present invention |
| 9. Ammonium ferric chelate of compound 1-17 | 12% | None | No precipitate | Present invention |
| 10. Ammonium ferric chelate of compound 1-19 | 13% | None | No precipitate | Present invention |
| 11. Ammonium ferric chelate of compound 1-21 | 13% | None | No precipitate | Present invention |
| 12. Ammonium ferric chelate of compound 1-22 | 10% | None | No precipitate | Present invention |
| 13. Ammonium ferric chelate of compound 1-24 | 14% | None | No precipitate | Present invention |
| 14. Ammonium | 10% | None | No | Present |

TABLE 1-continued

| Ferric chelate compound | Reduction range | Residue | Condition of reducer after 2 days elapsed | Remarks |
|---|---|---|---|---|
| ferric chelate of compound 1-25 | | | precipitate | invention |
| 15. Ammonium ferric chelate of compound 1-28 | 13% | None | No precipitate | Present invention |
| 16. Ammonium ferric chelate of compound 1-29 | 12% | None | No precipitate | Present invention |
| 17. Ammonium ferric chelate of compound 1-30 | 10% | None | No precipitate | Present invention |
| 18. Ammonium ferric chelate of compound 1-32 | 10% | None | No precipitate | Present invention |
| 19. Ammonium ferric chelate of compound 1-34 | 11% | None | No precipitate | Present invention |
| 20. Ammonium ferric chelate of compound 1-37 | 14% | None | No precipitate | Present invention |
| 21. Ammonium ferric chelate of compound 1-38 | 14% | None | No precipitate | Present invention |
| 22. Ammonium ferric chelate of compound 1-50 | 11% | None | No precipitate | Present invention |
| 23. Ammonium ferric chelate of compound 1-51 | 12% | None | No precipitate | Present invention |
| 24. Ammonium ferric chelate of compound 1-53 | 10% | None | No precipitate | Present invention |

As will be clear from Table 1, the reducers according to the present invention have remarkably widened reduction ranges and leave no residue. Further, with the reducer 2 employing ferric 1,3-diaminopropanetetraacetic acid chelate, a precipitate separated out with time, resulting in a lowering of the reducibility. However, with the reducers of the present invention, such a problem did not arise.

EXAMPLE 2

A silver halide emulsion (average grain size: 0.25 μm; cubic) comprising 80 mol % of silver chloride, 19.5 mol % of silver bromide, and 0.5 mol % of silver iodide was subjected to gold sensitization and sulfur sensitization. Further, the following spectral sensitizer (1), development accelerator (2), hardener (3) and latex were successively added to the emulsion. Then, the emulsion was coated on polyethylene terephthalate:

(1) 3-carboxymethyl-5-[2-(3-ethylthiazolinidene)ethylidene]rhodanine;

(2) polyoxyethylenenonylphenyl ether(ethylene oxide group 50); and (3) mucochloric acid.

The resulting photosensitive material was exposed through a magenta contact screen and then developed for 1 minute at 32° C. with HS-5 (manufactured by Fuji Photo Film Co., Ltd.). Thereafter, the photosensitive material was reduced with each of the reducers having compositions as shown in Table 2 below. The results are shown in Table 2.

In Table 2, the rate of reduction was determined by obtaining the dot percent after treatment for 60 seconds, while the reducibility was determined by measuring the density after the silver image was reduced by 10% (the silver image density before the reduction: 4.60 or more). In addition, the condition of each reducer after 2 days elapsed was investigated.

TABLE 2

| Reducer* | | | | | |
|---|---|---|---|---|---|
| Ferric chelate compound ($1.2 \times 10^{-1}$ mol/liter) | Reduction accelerator ($1.6 \times 10^{-3}$ mol/liter) | Rate of reduction | Reducibility | Condition of reducer after 2 days elapsed | Remarks |
| 1. Ammonium (ethylenediaminetetra-aceto) ferric chelate | 2-1 | 42% | 3.0 | No precipitate | Comp. Example |
| 2. Ammonium (1,3-diaminopropanetetra aceto) ferric chelate | 2-9 | 37% | 3.7 | Precipitate separated out | Comp. Example |
| 3. Ammonium ferric chelate of compound 1-7 | 2-3 | 38% | 3.6 | No precipitate | Present invention |
| 4. Ammonium ferric chelate of compound 1-15 | 2-5 | 34% | 4.2 | No precipitate | Present invention |
| 5. Ammonium ferric chelate of compound 1-18 | 2-7 | 37% | 3.8 | No precipitate | Present invention |
| 6. Ammonium ferric chelate of compound 1-23 | 2-8 | 33% | 4.3 | No precipitate | Present invention |
| 7. Ammonium ferric chelate of compound 1-31 | 2-9 | 36% | 3.8 | No precipitate | Present invention |
| 8. Ammonium ferric chelate of compound 1-49 | 2-10 | 32% | 4.4 | No precipitate | Present invention |
| 9. Ammonium ferric chelate of compound 1-54 | 2-15 | 38% | 3.5 | No precipitate | Present invention |

*Ammonium thiosulfate $4.0 \times 10^{-1}$ mol/liter, pH adjusted to 5.0

It will be understood from Table 2 that the reducers of the present invention are superior in the rate of reduction and reducibility and so stable that no precipitate separates out with time.

EXAMPLE 3

The film obtained in Example 1 was exposed through a wedge for sensitometry by using a 150-line contact screen. Thereafter, the exposed film was developed for 30 seconds at 34° C. with a developing solution having the following composition and then subjected to fixing, washing and drying.

| Developing solution: | |
|---|---|
| Tetrasodium ethylenediaminetetraacetate | 1 g |
| Sodium hydroxide | 18 g |
| Potassium hydroxide | 55 g |
| 5-sulfosalicylic acid | 30 g |
| Boric acid | 20 g |
| Potassium sulfite | 110 g |
| n-butyldiethanolamine | 15 g |
| N-methyl-p-aminophenol sulfate | 0.3 g |
| Hydroquinone | 50 g |
| 2-methylbenztriazole | 0.4 g |
| Sodium bromide | 10 g |
| Water to make | 1 liter (pH: 11.6) |

As a fixing solution, GRF-1 (manufactured by Fuji Photo Film Co., Ltd.) was employed.

The dot silver image (dot percent: 50%) thus obtained was reduced with reducers as shown in Table 3 below. The results are shown in Table 3.

In Table 3, the rate of reduction was determined by obtaining the dot percent after treatment for 60 seconds, while the reducibility was determined by measuring the density after the silver image was reduced by 10% (the silver image density before the reduction: 4.60 or more). In addition, reduction working properties and the condition of each reducer after 2 days elapsed were investigated.

TABLE 3

| Ferric chelate compound ($7.4 \times 10^{-2}$ mol/liter) | Reducer: Complex-forming agent ($1.5 \times 10^{-2}$ mol/liter) | Reducer: Dye ($2.3 \times 10^{-4}$ mol/liter) | Rate of reduction | Reducibility | Reduction working properties | Condition of reducer after 2 days elapsed | Remarks |
|---|---|---|---|---|---|---|---|
| 1. Ammonium (ethylenediaminetetraaceto) ferric chelate | — | — | 49% | 1.8 | Light-yellow Difficult to perceive outflow Not dyed | No precipitate | Comp. Example |
| 2. Ammonium (1,3-diaminopropanetetra aceto) ferric chelate | 1,3-diaminopropanetetraacetic acid | 3-2 | 46% | 3.7 | Reduced portion dyed | Precipitate separated out | Comp. Example |
| 3. Ammonium ferric chelate of compound 1-1 | 1-1 | 3-2 | 44% | 3.8 | Reduced portion dyed | No precipitate | Present invention |
| 4. Ammonium ferric chelate of compound 1-24 | 1-24 | 3-5 | 42% | 4.0 | Reduced portion dyed | No precipitate | Present invention |
| 5. Ammonium ferric chelate of compound 1-26 | 1-26 | 3-1 | 42% | 4.0 | Reduced portion dyed | No precipitate | Present invention |
| 6. Ammonium ferric chelate of compound 1-29 | 1-29 | 3-3 | 45% | 3.8 | Reduced portion dyed | No precipitate | Present invention |
| 7. Ammonium ferric chelate of compound 1-37 | 1-37 | 3-5 | 45% | 3.7 | Reduced portion dyed | No precipitate | Present invention |
| 8. Ammonium ferric chelate of compound 1-53 | 1-53 | 3-4 | 46% | 3.7 | Reduced portion dyed | No precipitate | Present invention |

It will be understood from Table 3 that the reducers of the present invention are superior in the rate of reduction, reducibility and reduction working properties and so stable that no precipitate separates out with time.

What we claim is:

1. A reducer, comprising:

a ferric chelate compound of at least one amino compound represented by the formula:

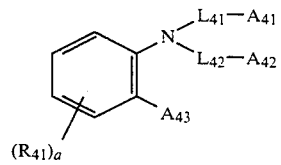

wherein $A_{41}$, $A_{42}$ and $A_{43}$ each individually represents a carboxyl group, a phosphono group, a sulfo group or a hydroxyl group; $L_{41}$ and $L_{42}$ each individually represent a divalent coupling group containing an aliphatic group, an aromatic group, a heterocyclic group or combinations thereof; $R_{41}$ represents a substituent; and a represents 0, 1, 2, 3 or 4; and a reduction accelerator represented by the formula:

$$A^1-(B^1)_h-A^2(Z^1)_i$$

wherein $A^1$ and $A^2$ each represents

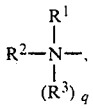

or a saturated or unsaturated heterocyclic residue containing at least one nitrogen. atom; $A^1$ and $A^2$ may be the same or different; $R^1$, $R^2$ and $R^3$ each represents a hydrogen atom or an alkyl group; $R^1$, $R^2$ and $R^3$ may be the same or different; q is 0 or 1; a nitrogen atom in the heterocyclic residue may be in the form of a quaternary ammonium salt, and the heterocyclic residue may contain an oxygen atom or a sulfur atom; $B^1$ represents a divalent organic group comprising alkylene, alkenylene, arylene, $—SO_2—$, —SO—, —S—, —O—, $$—\underset{\underset{O}{\|}}{C}—,\ \text{or}\ —\underset{\underset{R^4}{|}}{N}—$$

($R^4$ represents hydrogen atom, an alkyl group, or an aryl group) alone or in combination; h is 0 or 1; $Z^1$ represents an anion; and i is 0, 1 or 2.

2. A reducer as claimed in claim 1, wherein $A_{41}$, $A_{42}$ and $A_{43}$ each individually represents a carboxyl group or a hydroxyl group.

3. A reducer as claimed in claim 2, wherein $A_{41}$, $A_{42}$ and $A_{43}$ each individually represents a carboxyl group.

4. A reducer as claimed in claim 1, wherein $L_{41}$ and $L_{42}$ each individually represents: an alkylene group having 1 to 10 carbon atoms; an arylene group having 6 to 10 carbon atoms; an aralkylene group having from 7 to 10 carbon atoms; a group comprising a combination of —O—, —S—, —CO—, $—NR_o—$ or $—SO_2—$ and an alkylene or arylene group, where $R_o$ is a hydrogen atom, an aliphatic group, an aromatic group, a heterocyclic group or a hydroxyl group; or a combination thereof.

5. A reducer as claimed in claim 4, wherein $L_{41}$ and $L_{42}$ each individually represents:

$$—CH_2—,\ —CH_2CH_2—,\ —CH_2CH_2CH_2—,\ —\overset{\overset{CH_3}{|}}{CH}—,$$

-continued

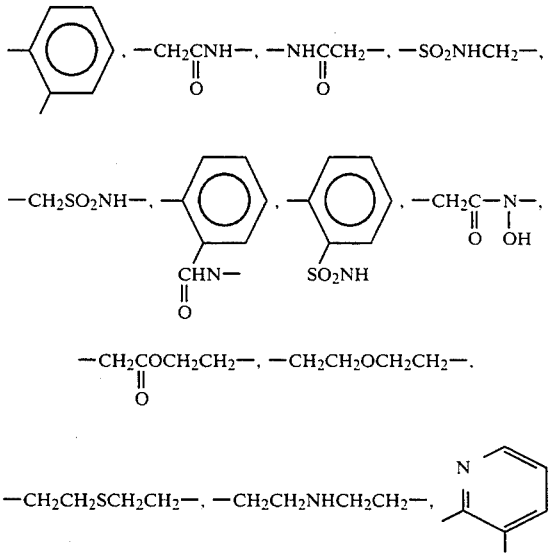

$R_{11}$ and $R_{12}$ each represents hydrogen atom, an aliphatic group, an aromatic group, or a heterocyclic group.

6. A reducer as claimed in claim 5, wherein $L_{41}$ and $L_{42}$ each individually represents $—CH_2—$ or $—CH_2CH_2—$.

7. A reducer as claimed in claim 1, wherein $R_{41}$ represents hydrogen, an alkyl group, an aralkyl group, an alkenyl group, an alkynyl group, an alkoxyl group, an aryl group, an amino group, an acylamino group, a sulfonylamino group, a ureido group, a urethane group, an aryloxyl group, a sulfamoyl group, a carbamoyl group, an alkylthio group, an arylthio group, a sulfonyl group, a sulfinyl group, a hydroxyl group, a halogen atom, a cyano group, a sulfo group, a carboxyl group, a phosphono group, an aryloxycarbonyl group, an acyl group, an alkoxycarbonyl group, an acyloxyl group, a carbonamido group, a sulfonamido group, a nitro group, a hydroxamic group or a heterocyclic group.

* * * * *